US009591884B2

(12) United States Patent
Jurga et al.

(10) Patent No.: US 9,591,884 B2
(45) Date of Patent: Mar. 14, 2017

(54) ERGONOMIC FACEMASK FOR AN ATHLETIC HEADPIECE

(71) Applicant: Ampac Enterprises Inc., Shirley, MA (US)

(72) Inventors: Brad Jurga, Shirley, MA (US); Shyan-Wei Chen, Taipei Hsien (TW)

(73) Assignee: Ampac Enterprises Inc., Shirley, MA (US)

( * ) Notice: Subject to any disclaimer, the term of this patent is extended or adjusted under 35 U.S.C. 154(b) by 261 days.

(21) Appl. No.: 13/873,880

(22) Filed: Apr. 30, 2013

(65) Prior Publication Data

US 2014/0317819 A1 Oct. 30, 2014

(51) Int. Cl.
*A42B 3/20* (2006.01)

(52) U.S. Cl.
CPC ..... *A42B 3/20* (2013.01); *A42B 3/205* (2013.01)

(58) Field of Classification Search
CPC ..... A42B 3/18; A42B 3/20; A42B 3/22
USPC ..... 2/425
See application file for complete search history.

(56) References Cited

U.S. PATENT DOCUMENTS 5,267,353 A * 12/1993 Milligan ..... 2/9
D412,376 S * 7/1999 Jurga et al. ..... D29/106
5,953,761 A * 9/1999 Jurga et al. ..... 2/425
D448,528 S * 9/2001 Fujimoto et al. ..... D29/111
6,854,128 B1 * 2/2005 Faulk ..... 2/9
6,931,664 B1 * 8/2005 Chen ..... 2/9
6,934,971 B2 * 8/2005 Ide et al. ..... 2/425
6,983,487 B2 * 1/2006 Rickon ..... 2/9
D587,852 S * 3/2009 Nimmons ..... D29/106
D587,853 S * 3/2009 Nimmons ..... D29/106
D587,854 S * 3/2009 Nimmons et al. ..... D29/106
D587,855 S * 3/2009 Nimmons et al. ..... D29/106
D587,857 S * 3/2009 Nimmons et al. ..... D29/122
D590,106 S * 4/2009 Nimmons ..... D29/122
D596,805 S * 7/2009 Leonardi ..... D29/108
D603,102 S * 10/2009 Polstein et al. ..... D29/111
7,886,370 B2 * 2/2011 Winningham ..... 2/421
7,900,279 B2 * 3/2011 Kraemer et al. ..... 2/425
8,209,784 B2 * 7/2012 Nimmons et al. ..... 2/424
8,327,466 B2 * 12/2012 Hahn et al. ..... 2/431
2006/0143765 A1 * 7/2006 Halstead et al. ..... 2/9
2007/0250992 A1 * 11/2007 Brown ..... 2/424
2009/0031479 A1 * 2/2009 Rush, III ..... 2/411
2009/0106883 A1 * 4/2009 Wade ..... 2/424
2009/0113606 A1 * 5/2009 Jourde et al. ..... 2/421
2010/0138981 A1 * 6/2010 Mangel, Jr. ..... 2/422
2011/0225706 A1 * 9/2011 Pye ..... 2/411
2011/0225708 A1 * 9/2011 Polstein et al. ..... 2/425
(Continued)

*Primary Examiner* — Richale Quinn
*Assistant Examiner* — Anne Kozak
(74) *Attorney, Agent, or Firm* — Smith, Gambrell & Russell, LLP

(57) ABSTRACT

An ergonomic facemask for a headpiece, including a wire cage having a plurality of horizontal wires and a plurality of vertical wires. The plurality of horizontal wires includes a horizontal wire configured to extend forward of a user's face at a height between the user's nose and the user's upper lip, and the plurality of vertical wires includes a center vertical wire that extends along the sagittal line of a user's face. The mutual arrangement of the center vertical wire together with the horizontal wire adequately shields a user's face while avoiding interference with the user's field of view.

19 Claims, 8 Drawing Sheets

(56) References Cited

U.S. PATENT DOCUMENTS

| | | | | |
|---|---|---|---|---|
| 2012/0137413 | A1* | 6/2012 | DeBoer | 2/424 |
| 2012/0180204 | A1* | 7/2012 | Hawkins | 2/424 |
| 2013/0067645 | A1* | 3/2013 | Musal et al. | 2/414 |
| 2013/0219595 | A1* | 8/2013 | Musal | 2/414 |
| 2014/0020153 | A1* | 1/2014 | Romanski et al. | 2/206 |
| 2014/0325727 | A1* | 11/2014 | Allen et al. | 2/9 |
| 2014/0352039 | A1* | 12/2014 | Abbey et al. | 2/421 |

* cited by examiner

ERGONOMIC FACEMASK FOR AN ATHLETIC HEADPIECE

FIELD OF THE INVENTION

The present invention relates to protective headgear; and, more particularly, to a facemask for a headpiece, and a headpiece with the facemask, in particular, the present invention relates to an athletic headpiece having an ergonomic facemask.

BACKGROUND OF THE INVENTION

In sports, there is often a risk of injury from a moving ball or other projectile. For example, when pitching or playing the field in baseball or softball there is a risk that a player might be struck in the face with a ball. Given the risk of injury, it is common for players to wear protective headgear. For example, a player might wear a headpiece 10, such as that shown in FIGS. 1-2; or a headpiece 30, such as that shown in FIGS. 3-4. However, headpieces 10 and 30 and other similar types of headpieces have certain deficiencies.

For example, headpiece 10 obstructs a player's vision and may interfere with a player's ability to engage during play. In particular, as shown in FIG. 1, headpiece 10 includes a guard 20 having a horizontal component 21 that extends forward of a player's nose. In addition to guarding the player's nose from injury, the horizontal component 21 is designed to extend to a relatively high height to thereby narrow an eye opening 22 and prevent a ball from passing through and striking the player's eyes. However, this design has the undesired side effect of limiting the player's field of view. As shown in FIG. 1, the increased height of the horizontal component 21 significantly decreases the lower bound of a player's field of view from a normal lower bound B1 to only a limited lower bound B2. This also creates a "blind zone" BZ between the normal lower bound B1 and the limited lower bound B2. The loss to the player's field of view can prevent the player from properly performing during a game. For example, as shown in FIG. 2, a softball player wearing headpiece 10 and attempting to field a ground ball 50 will not be able to visually follow the ball 50 to their glove 60 due to the limited lower bound B2 and the blind zone BZ created. This, in turn, increases the likelihood that the player will fail to properly stop the ball 50, which may result in the player failing to successfully complete a potentially game-changing play.

Headpiece 30, in FIGS. 3-4, attempts to solve the field of view problems that result from headpiece 10, but fails to fully address the problem and presents additional risks. In particular, headpiece 30 includes a horizontal wire 41 that extends forward of a player's nose, thereby protecting the player's nose from injury. However, to decrease interference to the player's field of view, the horizontal wire 41 extends to a lower elevation than that of the horizontal wire 21 in the headpiece 10. Nonetheless, even with this lower elevation of the horizontal wire 41, headpiece 30 still limits the lower bound of a player's field of view, though to a lesser degree than the headpiece 10. In addition, however, a lowered horizontal wire, such as the wire 41, increases the dimensions "X1" and "Y1" of an eye opening (e.g., the eye opening 42 in headpiece such as 30), to such a degree that it is possible for a ball to travel through and injure the player. Thus, while some headpieces, such as headpiece 30, have less interference to the player's field of view because of a lowered horizontal wire, there remains serious risk of injury to a player wearing the headpiece.

Accordingly, there is a need in the art for a protective headpiece that adequately protects a player's face, while at the same time not interfering with the player's field of view and performance. In particular, it would be desirable to provide a fielding headpiece that protects a player's nose and eyes while not interfering with the player's field of view.

SUMMARY OF THE INVENTION

The present invention provides an ergonomic facemask for a headpiece, and a headpiece including the ergonomic helmet. In one embodiment, the athletic headpiece includes a headband for contacting a user's forehead, a harness for contacting the back of a user's head, a plurality of straps for securing the harness to the headband, a facemask secured to the headband, and a chin pad for contacting a user's chin.

In one aspect, the facemask includes a wire cage having a plurality of horizontal wires and a plurality of vertical wires. The plurality of horizontal wires includes a first horizontal wire configured to conform to a headband, and a second horizontal wire configured to extend forward of a user's face at a height between the user's nose and the user's upper lip. The plurality of vertical wires includes a pair of lateral vertical wires and a center vertical wire that extends along the sagittal line of a user's face.

In one aspect, a sight window that aligns with a user's eyes is defined vertically between the first horizontal wire and the second horizontal wire, and is defined horizontally between the pair of lateral vertical wires. The sight window is free of any horizontal wires therein.

In another aspect, the center vertical wire shields a user's nose and forehead and also divides the sight window into a right-eye opening configured to align with a user's right eye and a left-eye opening configured to align with a user's left eye. A length of the center vertical wire between the first horizontal wire and the second horizontal wire is between 1.25 and 6, may be between 1.5 and 5, and may be approximately 4 inches.

In another further aspect, the facemask includes a pair of vertical lateral ends, and the ends of the second horizontal wire are affixed to the facemask at the vertical lateral ends. Furthermore, the second horizontal wire may slope from a higher height at its ends where it is affixed to the lateral ends of the facemask to a lower height at a center, anterior point. The difference in height between the height of the end-points and the height of the center, anterior point is between 0.5 and 6 inches, though it may be between 1 and 4 inches, or between 1.25 and 2 inches, and may be approximately 1.5 inches.

In a further aspect, the mutual arrangement of the center vertical wire, including its length and sagittal alignment, together with the second horizontal wire, including its sloping height difference and forward alignment relative to a user's face, acts to shield a user's face while also avoiding interference with the user's field of view.

The present invention also relates to a method of manufacturing the facemask and/or athletic headpiece by shaping the facemask from metal, plastic, or a combination thereof. In one embodiment, the method of manufacturing includes shaping the individual wires in the wire cage separately and affixing the wires to one another to form the wire cage. In another embodiment, the method of manufacturing includes shaping the entire wire cage as a monolithic structure. In these embodiments, the wires may be constructed with round, rectangular, oval, or flat cross-sections, and may be either solid or hollow. In addition, different wires in the wire grid may have different cross-section shapes and different cross-section types (e.g., solid or hollow).

Both the foregoing general description and the following detailed description are exemplary and explanatory only and provide an explanation of the invention as claimed. The accompanying drawings are incorporated in and constitute part of this specification, and are included to provide a further understanding of the invention; to illustrate several embodiments of the invention; and, with the description, explain the principles of the invention.

BRIEF DESCRIPTION OF THE DRAWINGS

Further features and advantages of the invention may be ascertained from the following detailed description in connection with the drawings described below.

DETAILED DESCRIPTION OF THE INVENTION

The present invention relates to a protective facemask and protective headpieces with a protective facemask. In particular, the present invention relates to an ergonomic facemask and an athletic headpiece, and particularly a pitcher's or a fielder's headpiece with the ergonomic facemask, and methods of making the facemask and the headpiece with the facemask.

The following disclosure discusses the present invention with reference to examples in the accompanying drawings, though does not limit the invention to those examples. For example, although the following discussion addresses exemplary configurations of the novel facemask in softball and baseball headpieces, the inventors contemplate the facemask and headpiece to be useful in other athletic activities, as well as in other types of non-athletic activities.

Headpiece

Figure 1:
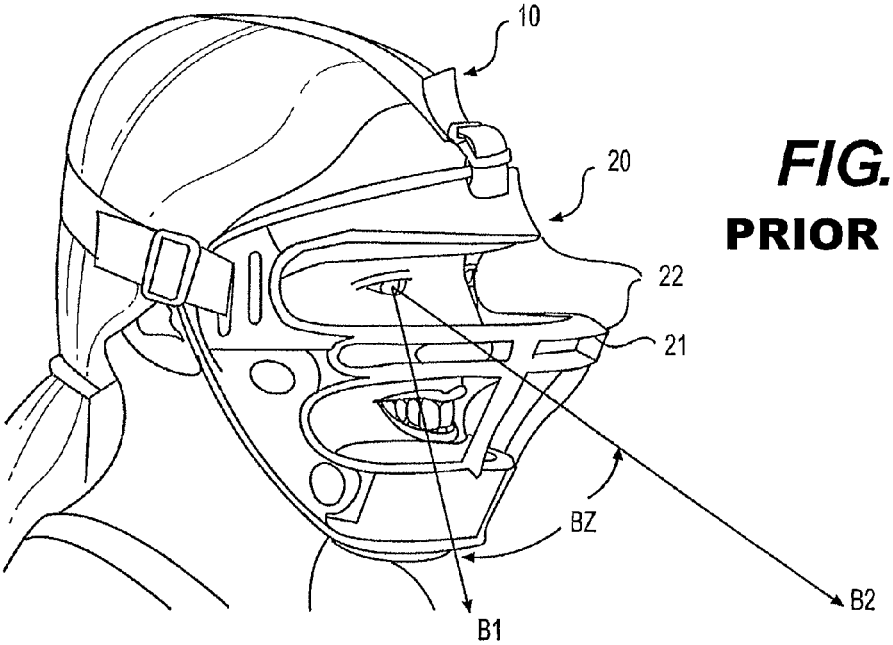
FIG. 1 PRIOR ART
FIG. 1 illustrates a perspective view of a person wearing a first conventional protective headpiece.
Figure 2:
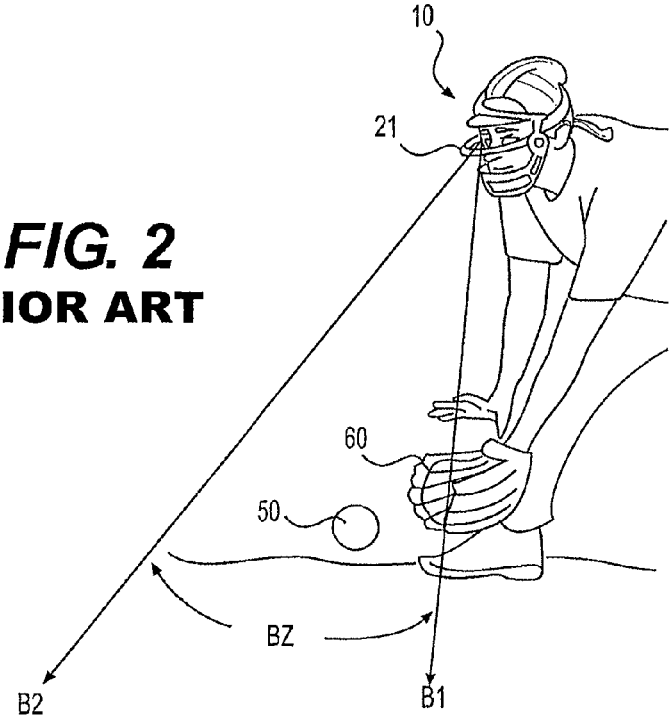
FIG. 2 PRIOR ART
FIG. 2 illustrates a further perspective view of a player wearing the conventional headpiece of FIG. 1, while attempting to field a ground ball.
Figure 3:
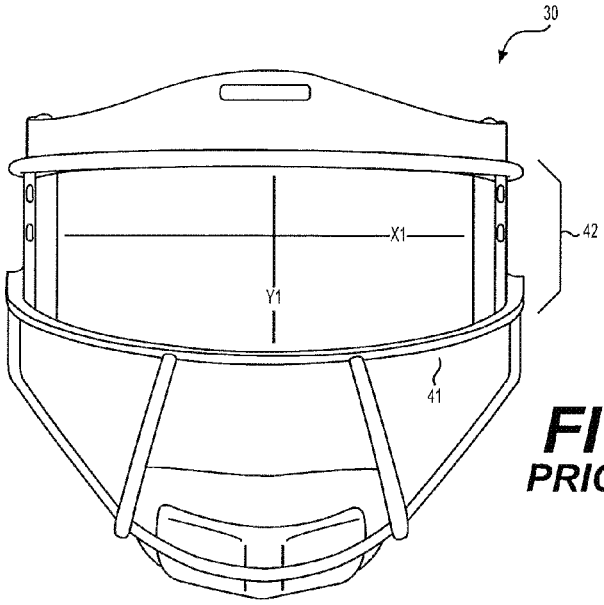
FIG. 3 PRIOR ART
FIG. 3 illustrates a front view of a second conventional headpiece.
Figure 4:
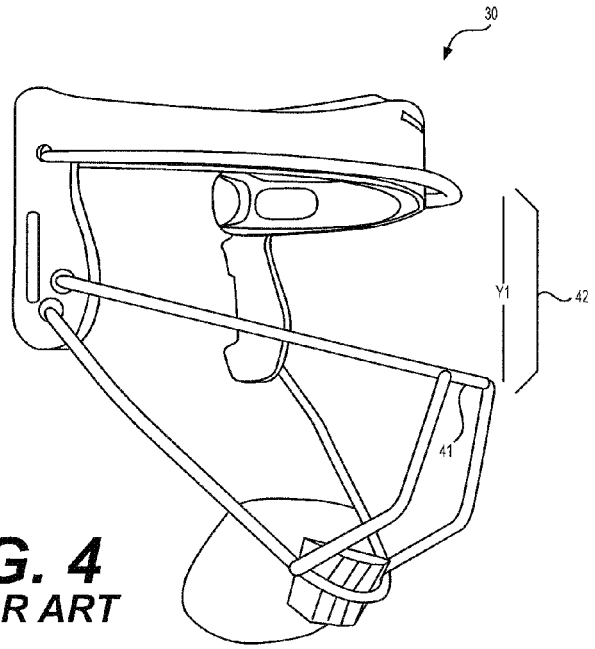
FIG. 4 PRIOR ART
FIG. 4 illustrates a profile view of the second conventional headpiece of FIG. 3.
Figure 5:
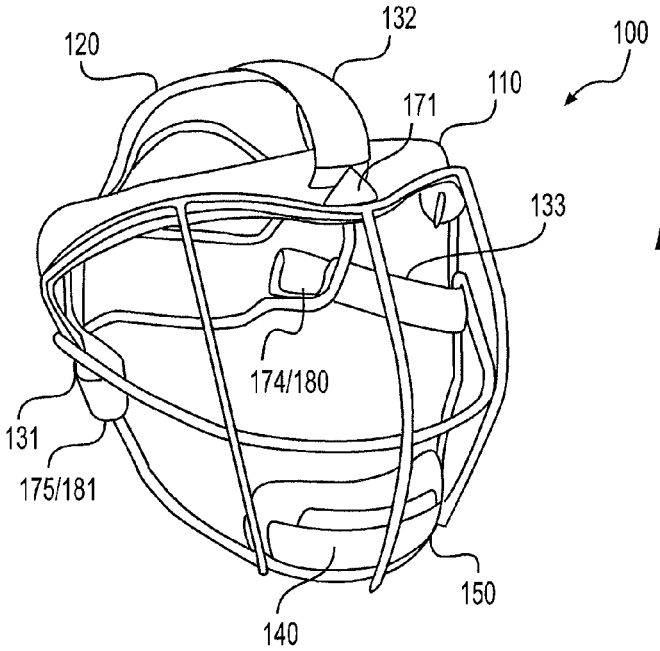
FIG. 5 illustrates a perspective view of a facemask according to a first embodiment of the present invention.
Figure 6:
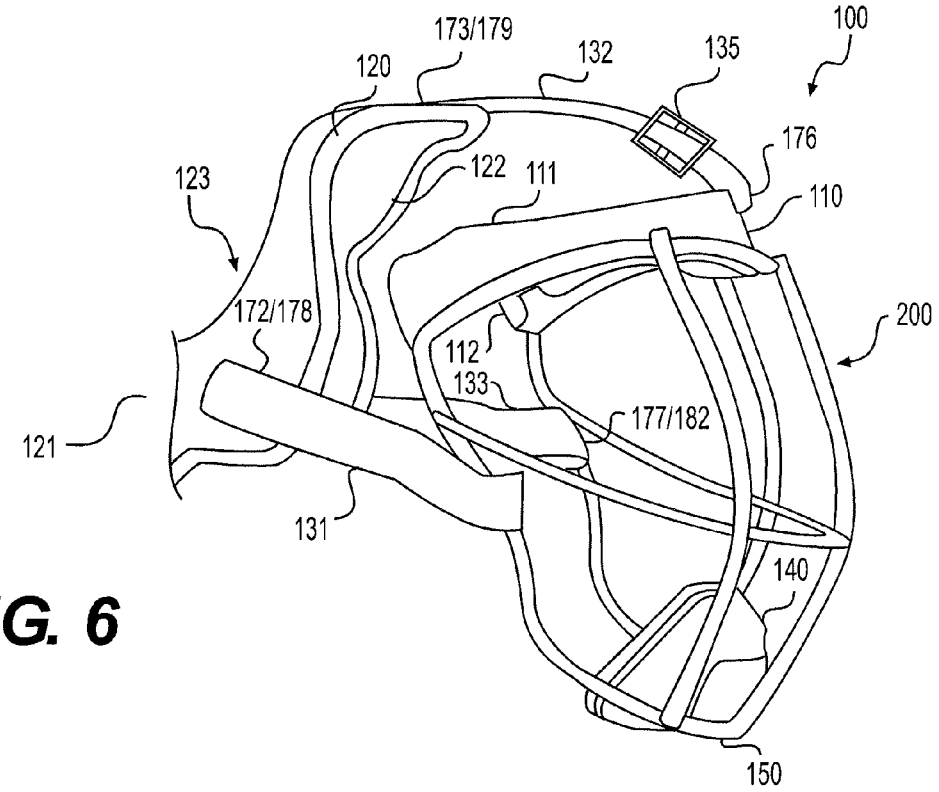
FIG. 6 illustrates a profile view of the facemask of FIG. 5.

In one embodiment, as shown in FIGS. 5-6, the headpiece 100 is a softball headpiece; and includes a headband 110, a harness 120 and a facemask 200. A plurality of straps 131, 132 and 133 extend from the harness 120 to engage the headband 110 and the facemask 200; and a chin pad 140 is affixed to the facemask 200 by a plate 150.

Figure 7:
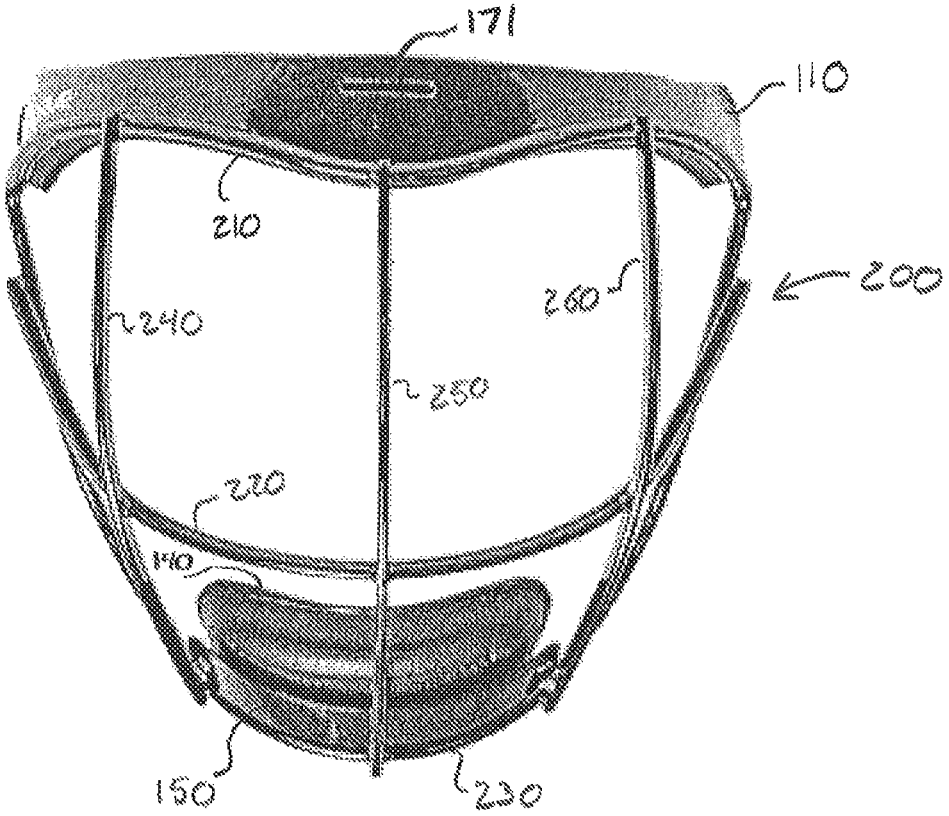
FIG. 7 illustrates a front view of the facemask of FIG. 5.

As shown in FIGS. 5-7, the headband 110 is an arcuate band arranged within the headpiece 100 to contact and extend horizontally across a user's forehead. The headband 110 includes an outer shell 111 and an inner cushioning layer 112, which together protect a user from impact energies, such as from a softball striking the headband 110 or the facemask 200. The headband 110 further includes one or more first fasteners 171 for engaging one or more of the straps 131-133.

As shown in FIGS. 5-6, the harness 120 is arranged in the headpiece 100 to contact the back of a user's head. In one example, the harness 120 may be constructed as a shell of metal or plastic that provides a protective shielding to the back of a user's head. In another example, the harness 120 may be constructed of a fabric material that provides a soft fit to the back of a user's head; and, in particular, may be made of an elastic fabric that provides a shape conforming and compression fit to the back of a user's head. In one embodiment, one or more parts of the harness 120 are formed from a synthetic rubber material, such as neoprene or polychloroprene. In a further example, the harness 120 may be constructed as a combined shell-and-fabric harness having an outer shell 121 of a first material and an inner layer 122 made of one or more cushioning materials. The harness 120 further includes a plurality of second fasteners 172, 173 and 174 for engaging the straps 131-133. In some examples, the harness 120 may include a cavity 123, either through a center of the harness body or a in a perimeter of the harness body, that permits a user to extend their hair therethrough (e.g., a pony tail opening).

As shown in FIGS. 5-6, one or more straps 131-133 are arranged in the headpiece 100 to extend between the harness 120 and the headband 110, and between the harness 120 and the facemask 200. The straps 131-133 may be constructed of either an elastic material or an inelastic material. If constructed of an elastic material, the straps 131-133 may stretch sufficiently to permit a user to put-on and take-off the headpiece 100 while still remaining secured to the harness 120, headband 110, and facemask 200. If constructed of an inelastic material, then the straps 131-133 may be releasably secured to one or more of the harness 120, headband 110 and facemask 200. The straps 131-133 may include one or more of: third fasteners 175, 176, 177 for engaging the first fastener 171 on the headband 110 and fifth fasteners on the facemask 200; fourth fasteners 178, 179 and 180 for engaging the second fasteners 172, 173 and 174 on the harness 120; and/or adjusters 134, 135 and 136 that permit a user to tighten or loosen a fitting of the respective strap.

The plurality of straps 131-133 may be permanently affixed at both ends or releasably fastenable at one or more ends, and the plurality of straps 131-133 may include a combination of permanently affixed and releasably fastenable straps. For example, the straps 131-133 may each be constructed as an individual band of fabric looped around a wire in the facemask 200 or through an opening 171 in the headband 110 with the two ends of each looped hand stitched to the harness 120, thereby permanently affixing the straps 131-133 within the headpiece 100. In another example, each strap 131-133 may again be constructed as an individual band of fabric looped around a wire in the facemask 200 or through an opening in the headband 171, though the two ends of each individual band may be stitched to one another with each stitched pair of band endings carrying a fastener 178-180 that releasably secures the respective strap 131-133 to the harness 120. In a further example, a first end of each strap 131-133 may be stitched to the harness 120 and the second end may carry a fastener 175-177 that releasably secures the respective strap 131-133 to the headband 110 or the facemask 200. In yet a further example, one or more straps (e.g., a center strap 132) may be permanently affixed between the headband 110 and the harness 120, while one or more other straps (e.g., lateral straps 131 and 133) are releasably fastenable at one or both ends with the harness 120 and/or the facemask 200.

Facemask

The facemask 200 is a shield for protecting a user's face. In the example shown in FIGS. 5-7, the facemask 200 is constructed as a wire cage including a plurality of horizontal wires and a plurality of vertical wires. The plurality of horizontal wires may include a first horizontal wire 210, a second horizontal wire 220, and a third horizontal wire 230. The plurality of vertical wires may include a pair of lateral vertical wires 240 and 260, and a center vertical wire 250. The facemask 200 may further include fifth fasteners 181 and 182 arranged at lateral end 270 and 280 of the wire cage 201 for engaging with third fasteners 175 and 176 on the straps 131 and 133.

The first horizontal wire 210 is the highest horizontal wire in the wire cage 201 and represents the top perimeter of the facemask 200. The first horizontal wire 210 conforms substantially to and engages the headband 110, and may be referred to as the mount 210 (or mounting wire 210). The first horizontal wire 210 may engage the headband 110 by a releasable fastener, or may be permanently affixed to the headband 110.

Figure 8:
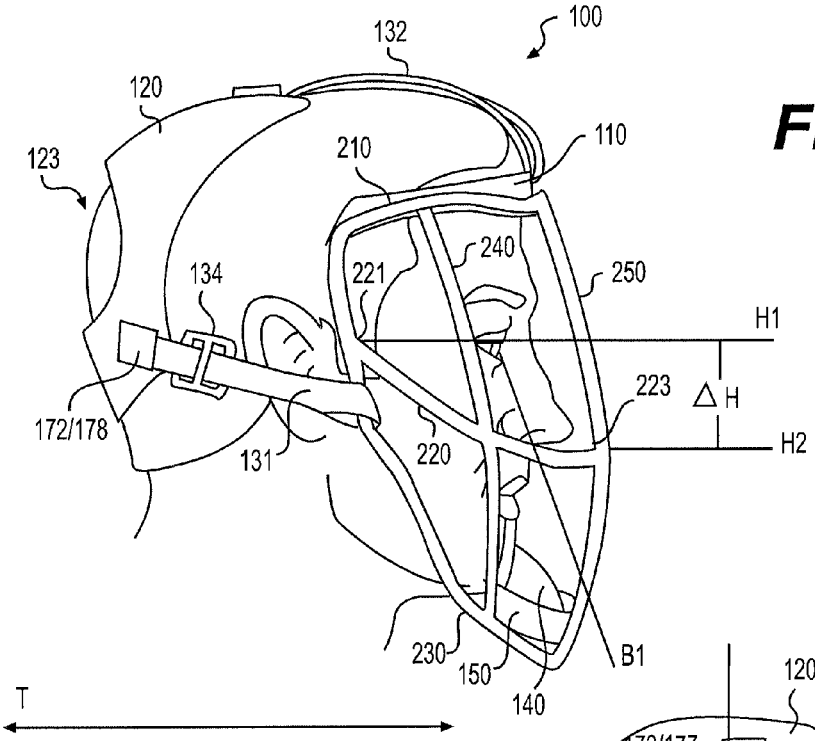
FIG. 8 illustrates a profile view of a user wearing the facemask of FIG. 5.
Figure 9:
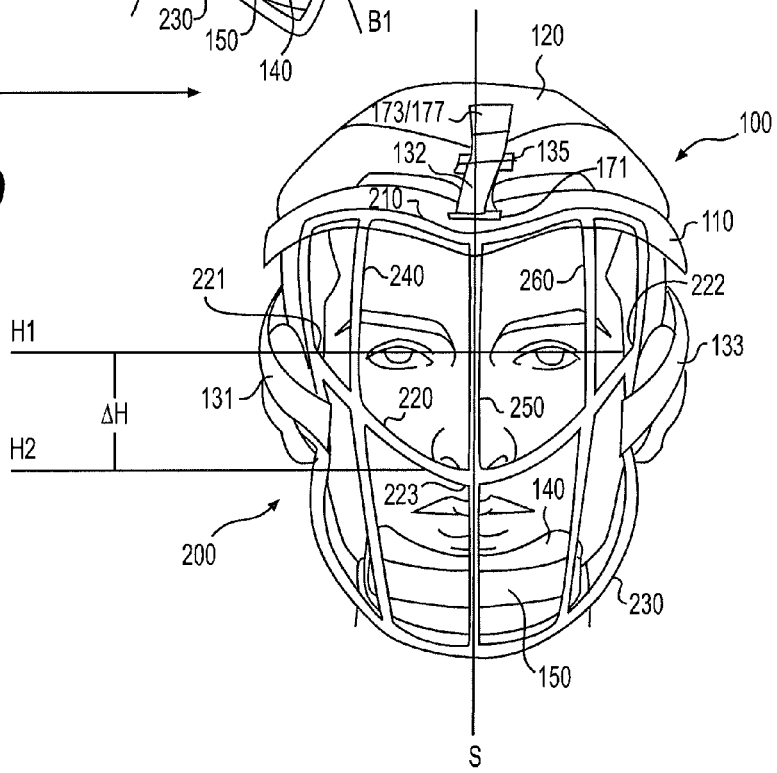
FIG. 9 illustrates a front view of a user wearing the facemask of FIG. 5.
Figure 11:
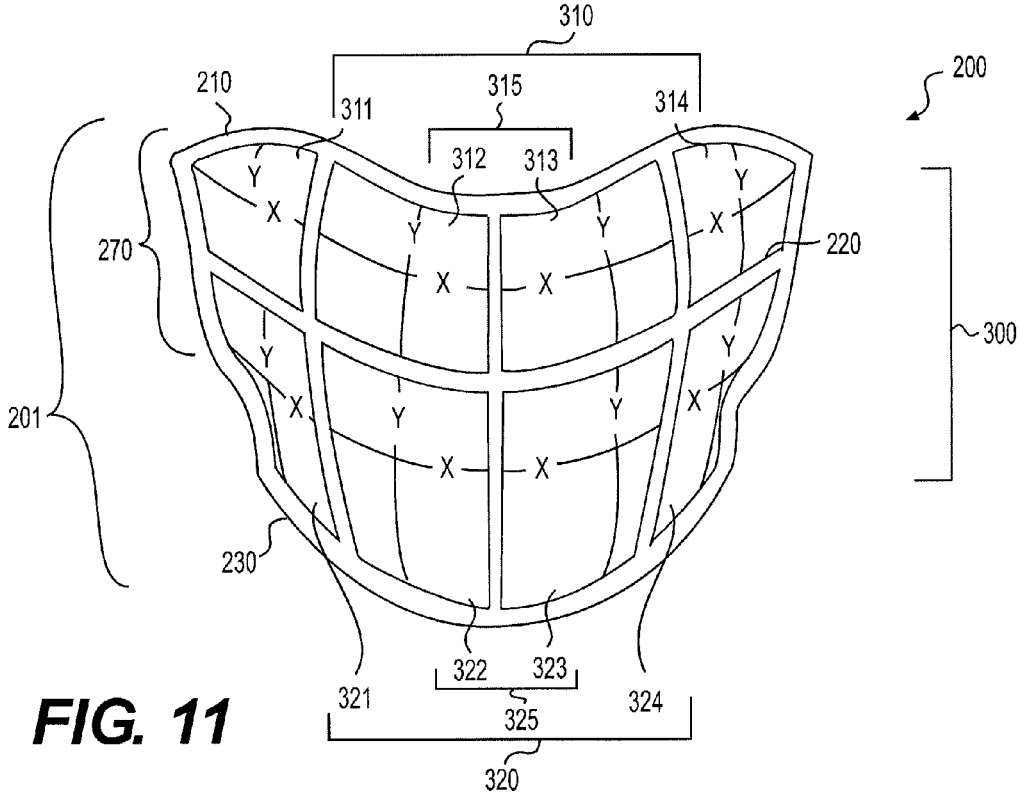
FIG. 11 illustrates a further front view of the wire cage of the facemask of FIG. 5.

The second horizontal wire 220 extends horizontally between the first horizontal wire 210 and the third horizontal wire 230. As shown in FIGS. 8-9, when the facemask 200 is worn by a user, the second horizontal wire 220 extends along the user's cheek bones and forward of the user's face at a height approximately between the bottom of the user's nose and the top of the user's lip (e.g., forward of the user's philtrum). As such, the second horizontal wire 220 may be referred to as the zygomatic guard (or zygomatic guard wire 220) or the maxilla guard (or maxilla guard wire). As shown in FIG. 11, the second horizontal wire 220 extends between a point 221 at the lateral end 270 and a point 222 at the lateral end 280 of the facemask 200 and divides a space 300, defined between the first horizontal wire 210 and the third horizontal wire 230, into an upper region 310 and a lower region 320.

The third horizontal wire 230 is the lowest horizontal wire in the wire cage 201 and represents the bottom perimeter of the facemask 200. As shown in FIGS. 8-9, when the facemask 200 is worn by a user, the third horizontal wire 230 extends along the user's lower jaw and forward of the user's face at a height approximately between the bottom of the user's bottom lip and 2 inches below the user's chin. In another example, the third horizontal wire 230 may extend along forward of the user's face at a height approximately between a height level with a user's chin and 1 inch below the user's chin. The third horizontal wire 230 may be referred to as the mandible guard (or mandible guard wire).

Figure 10:
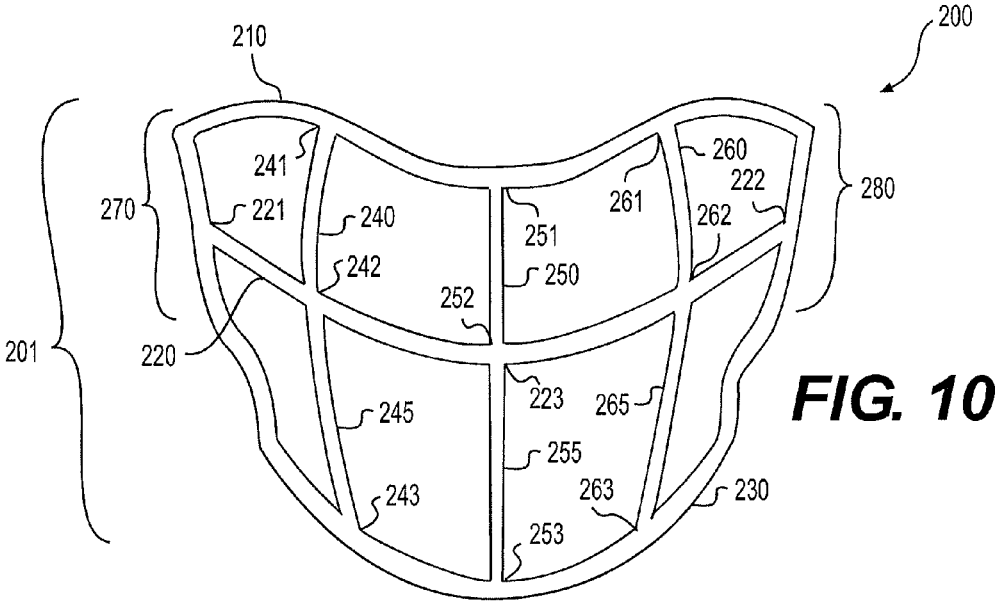
FIG. 10 illustrates a front view of a first embodiment of a wire cage of the facemask of FIG. 5.

As shown in FIG. 10, the vertical wires 240, 250 and 260 each extend from the first horizontal wire 210 to the second horizontal wire 220. The lateral vertical wires 240 and 260 extend vertically between points 241-242 and 261-262, respectively, on opposites sides of a center line "C" of the facemask 200; and the center vertical wire 250 extends vertically between points 251-252 on the center line "C". In the example shown in FIG. 10, the center vertical wire 250 has a length between 1.25 and 6 inches, though it may instead have a length between 1.5 and 5 inches, and may have an approximate length of 4 inches. As shown in FIG. 9, when observed relative to a user's face, the lateral vertical wires 240 and 260 extend vertically on opposites sides of the sagittal line "S"; and the center vertical wire 250 extends approximately along the sagittal line "S". The central vertical wire 250 may also be referred to as the sagittal guard (or the sagittal guard wire).

In the embodiment shown in FIG. 10, the facemask 200 includes lower vertical wires 245, 255 and 265 that align respectively with the vertical wires 240, 250 and 260 and extend between the second horizontal wire 220 and the third horizontal wire 230. These lower vertical wires 245, 255 and 265 may also be referred to respectively as vertical braces. In particular, the lower vertical wires 245, 255 and 265 may be monolithic extensions of the vertical wires 240, 250 and 260; or they may be separately formed wires that brace the second horizontal wire 220 and are affixed thereto either in-alignment our out-of-alignment with the vertical wires 240, 250 and 260. When the lower vertical wires 245, 255 and 265 are monolithic extensions of the vertical wires 240, 250 and 260, then these combined lengths of wire (e.g., 240+245; 250+255; and 260+265) may be referred to simply as the vertical wires 240, 250 and 260 extending respectively between points 241-243, 251-253 and 261-263. When the lower vertical wires 245, 255, and 265 are not monolithically formed with the vertical wires 240, 250 and 260, then the lower vertical wires may be referred to respectively as vertical braces.

Figure 12:
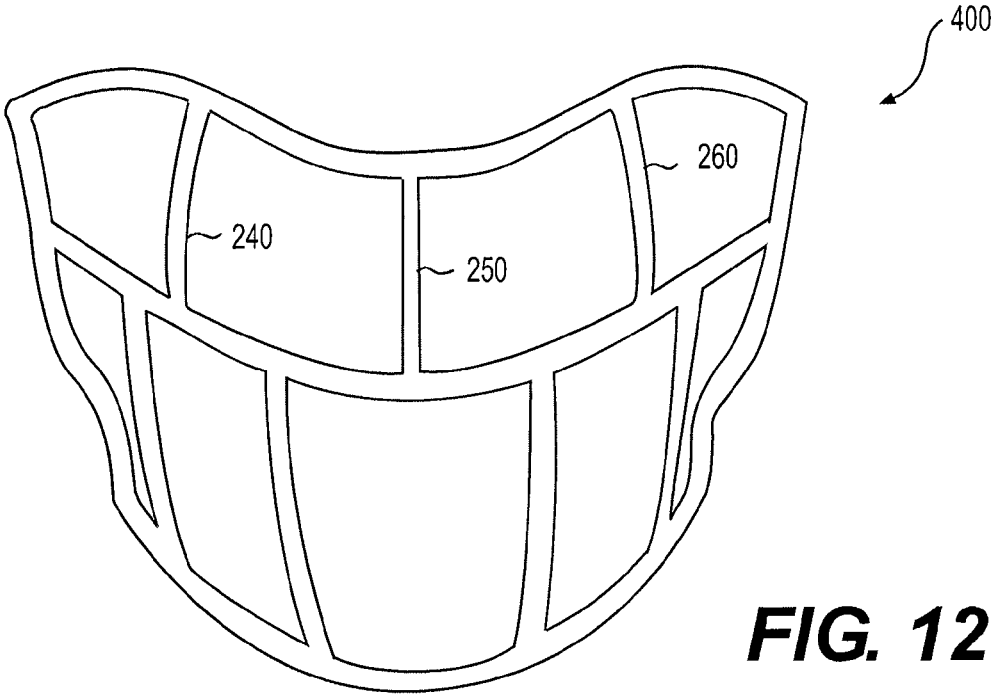
FIG. 12 illustrates a front view of a second embodiment of the wire cage of FIG. 10.
Figure 13:
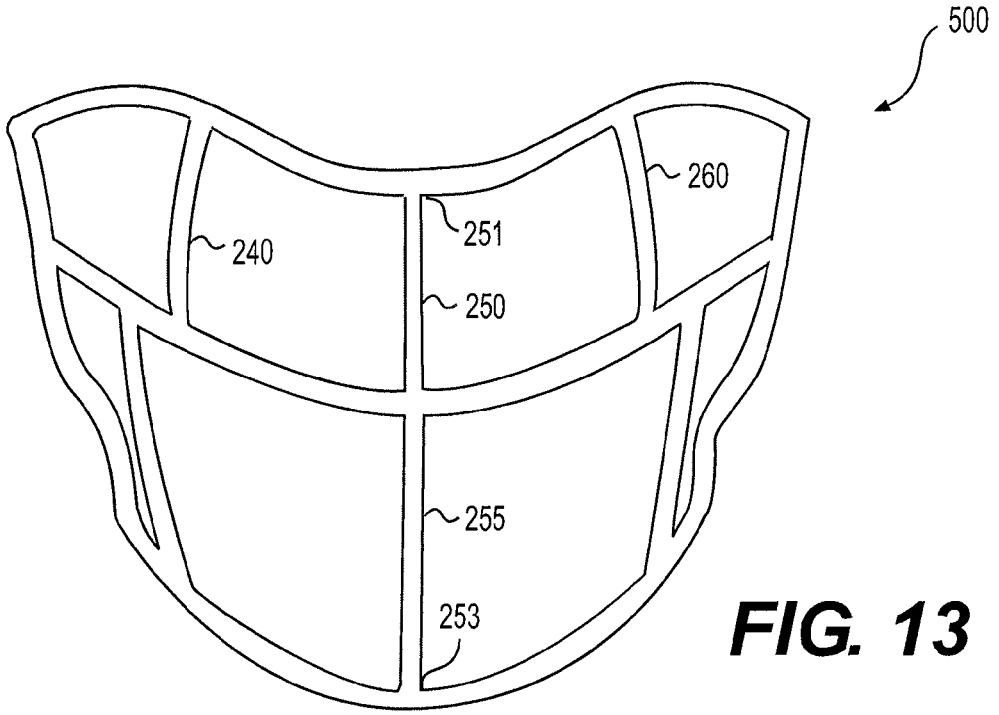
FIG. 13 illustrates a front view of a third embodiment of the wire cage of FIG. 10.
Figure 14:
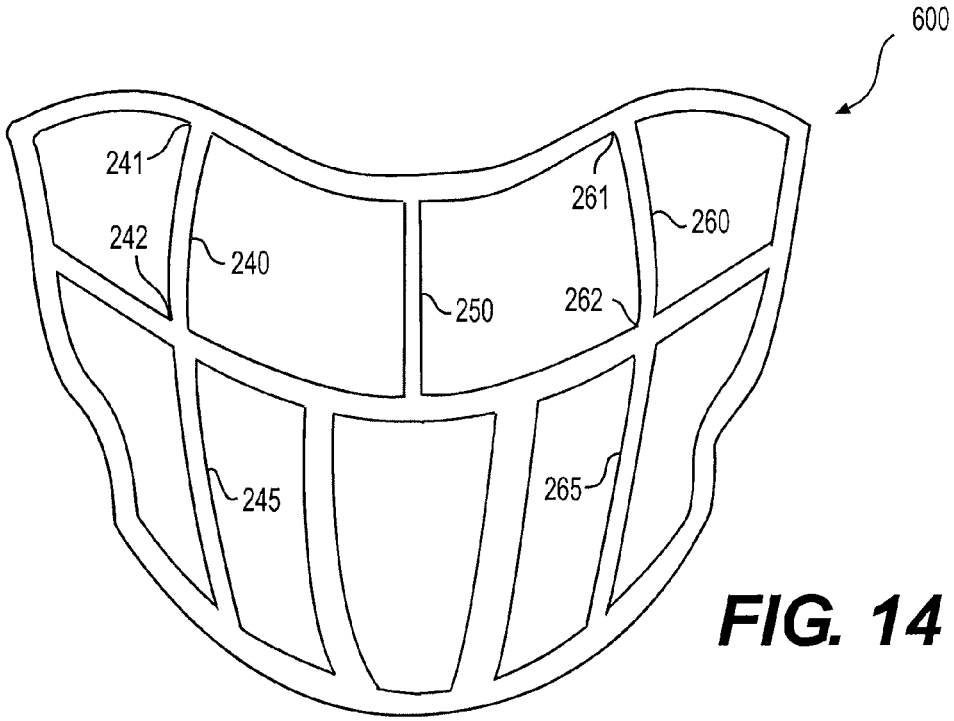
FIG. 14 illustrates a front view of a fourth embodiment of the wire cage of FIG. 10.
Figure 15:
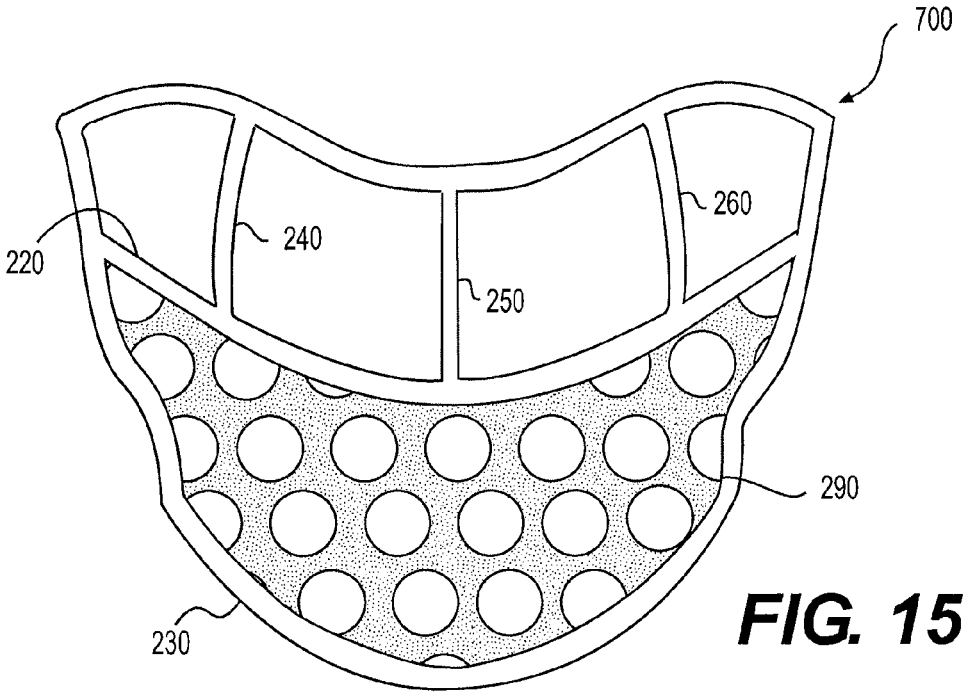
FIG. 15 illustrates a front view of a fifth embodiment of the wire cage of FIG. 10.

In one example of a wire cage suitable for use in the face mask 200 (shown in FIG. 10), as shown in FIG. 12, there may be four vertical braces on the wire cage 400, all of which are out-of-alignment with the vertical wires 240, 250 and 260. In another example of a wire cage suitable for use in the face mask 200 (shown in FIG. 10), as shown in FIG. 13, there may be a lower center vertical wire on the wire cage 500 that is a monolithic extension of the center vertical wire 250 (the center vertical wire 250 thus extending between points 251-253); and there may be two lateral vertical braces that are out-of-alignment with the lateral vertical wires 240 and 260. In a further example, as shown in FIG. 14, there may be two lateral vertical braces 245 and 265 that are aligned with, though separately formed from, the lateral vertical wires 240 and 260 (the lateral vertical wires 240 and 260 thus extending respectively only between points 241-242 and 261-262); and there may be two off-center vertical braces that are out-of alignment with the center vertical wire 250. In yet a further example, as shown in FIG. 15, each of the vertical wires 240, 250, and 260 may terminate at the second horizontal wire 220 and there may be no lower vertical wires or vertical braces between the second horizontal wire 220 and the third horizontal wire 230. Instead, one or more alternative support structures 290 may extend between the second horizontal wire 220 and the third horizontal wire 230, such as: a network of mesh wiring; and a shell structure (such as a polycarbonate shield or visor) with or without vent openings.

In the example shown in FIG. 11, the plurality of vertical wires 240, 250 and 260 overlap the plurality of horizontal wires 210, 220 and 230, with each of the vertical wires secured to each of the horizontal wires. The second horizontal wire 220 divides a space 300, defined between the first horizontal wire 210 and the third horizontal wire 230, into an upper region 310 and a lower region 320. The lateral vertical wires 240 and 260 sub-divide the upper region 310 into a pair of upper lateral openings 311 and 314 and an upper center opening 315. As shown in FIG. 9, the upper center opening 315 aligns with a user's eyes, and may be referred to as the sight window 315. When extending to the third horizontal wire 230, the lateral vertical wires 240 and 260 likewise sub-divide the lower region 320 into a pair of lower lateral openings 321 and 324 and a lower center opening 325. The center vertical wire 250 sub-divides the upper center opening 315 into an upper right-center opening 312 and an upper left-center opening 313 (with "right" and "left" being relative to a user's perspective when wearing the facemask 200). As shown in FIG. 9, the upper right-center and upper left-center openings 312 and 313 align respectively with a user's right and left eyes, and may be referred to respectively as the right-eye window and the left-eye window, respectively. When extending to the third horizontal wire 230, the center vertical wire 250 likewise sub-divides the lower center opening 325 into a lower right-center opening 322 and a lower left-center opening 323.

The openings in the facemask 200 are each sized and dimensioned dependent on the particular activity for which the facemask 200 is designed. In particular, if the facemask 200 is designed for use in a sport activity having a moving ball or other projectile then each of the openings is sized and dimensioned to prevent the ball or other projectile from passing a sufficient distance through any of the openings to contact a user's face. For example, if the facemask 200 is a softball facemask, then the openings are sized and dimensioned relative to a softball. Softballs generally have a circumference between 10 inches and 12.125 inches, and a diameter between 3.18 inches and 3.86 inches. In an embodiment, a facemask 200 may be constructed with openings having particular dimensions in the "x" and "y" directions shown in FIG. 11. In particular, the upper lateral openings 311 and 314 may measure 2.1 inches or less, and may be between 1.5 to 1 inch, in the x-horizontal direction; and may measure 3.2 inches or less, and may be between 2.4 and 1.6 inches, in the y-vertical direction. The lower lateral openings 321 and 324 may measure 2.3 inches or less, and may be between 1.75 and 1.2 inches, in the x-horizontal direction; and may measure 2.3 inches or less, and may be between 1.75 and 1.2 inches, in the y-vertical direction. The lower right-front and left-front openings 322 and 323 may measure 2.4 inches or less, and may be between 1.8 and 1.2 inches, in the x-horizontal direction; and may measure 2.9 inches or less, and may be between 2.2 and 1.5 inches, in the y-vertical direction. The upper right-front and left-front openings 312 and 313 may measure 2.8 inches or less, and may be between 2.1 and 1.4 inches in the x-horizontal direction; and may measure 6 inches or less, may be between 4 and 1 inch, and may be approximately 1.5 inches in the y-vertical direction.

In an alternative example, if the facemask 200 is designed for use in baseball then the "x" and "y" dimensions of the openings are instead determined relative to the dimensions of baseballs, which generally have a circumference between 9 inches and 9.125 inches, and a diameter between 2.87 inches and 2.94 inches. The same principles apply if constructing the facemask 200 for use in other athletic activities (e.g., as a hockey facemask the openings would have "x" and "y" measurements relative to the average dimensions of hockey pucks).

The plate 150, as shown in FIGS. 7-9, has an outer surface oriented away from a user's face and an inner surface oriented toward a user's face. The outer surface of the plate 150 is affixed to the facemask 200, and a chin pad 140 is affixed to the inner surface of the plate 150.

As shown in FIGS. 8-9, the plate 150 may be affixed to one or more of the vertical wires 240, 250 and 260 and extend horizontally without contacting the third horizontal wire 230. For example, the plate 150 may be affixed to and extend horizontally across one or more of the vertical wires 240, 250 and 260 at a height above and out-of-contact with the third horizontal wire 230. Alternatively, the plate 150 may be affixed to and extend along the third horizontal wire 230, without contacting any of the vertical wires 240, 250 and 260. For example, the vertical wires 240, 250, and 260 may be affixed to an outer surface of the third horizontal wire 230, while the plate 150 is affixed to and extends along an inner surface of the third horizontal wire 230. In a further alternative, the plate 150 may be affixed to the third horizontal wire 230 and one or more vertical wires 240, 250 and 260. The chin pad 140 is a cushioning layer that is arranged in the facemask 200 to contact a user's chin, and protects a user from impact energies, such as when a softball strikes the facemask 200.

In the foregoing examples, the center vertical wire 250 is configured to extend along the center line "C" and/or the sagittal line "S" (between either the points 251-252, or the points 251-253). When extending between the points 251-252, the center vertical wire 250 shields a player's nose, forehead, and upper jaw. When extending between the points 251-253, the center vertical wire 250 further shields a player's lower jaw.

Also in the foregoing examples, the second horizontal wire 220 extends between the lateral sides 270 and 280, and is configured to extend along a user's cheeks and forward of the user's face in a region between the user's nose and upper lip. With this arrangement the second horizontal wire 220 shield a user's cheek bones and upper jaw. However, with the low elevation of the second horizontal wire 220 at a height between a user's nose and upper lip, the second horizontal wire 220 does not interfere with the user's field of view. In particular, as shown in FIG. 8, the second horizontal wire 220 is positioned at such an elevation that it is below the normal lower bound B2 of a user's field of view.

Advantageously the facemasks of the foregoing examples avoid interference with a user's field of view while also continuing to adequately shield the user's face. In particular, whereas lowering the bottom wire of an eye-opening in a conventional facemask enlarges an eye-opening to a size that a ball might pass therethrough, the facemasks in the foregoing examples prevent any such risk by the combined arrangement of the second horizontal wire 220 and the center vertical wire 250. In particular, the lowered elevation of the second horizontal wire 220 avoids interference with a user's field of view while the center vertical wire 250 divides the upper center opening 315 into two smaller openings 312 and 313 that prevent a ball from passing therethrough.

With the combined arrangement of the second horizontal wire 220 and the center vertical wire 250, it's possible to lower the elevation of the second horizontal wire 220 to a height that is as much as 1½ inches lower than the bottom wire of an eye-opening in conventional facemasks, as measured in a caudal-to-cranial direction when a user wears a headpiece with the facemask 200 and levels their head with the transverse plane "T", as shown in FIGS. 8-9. In addition, the second horizontal wire 220 may extend from a relatively high height at its ends 221 and 222, to a relative low height at its forward-most point, an anterior point 223, that aligns approximately with the sagittal line "S". For example, as shown in FIGS. 8-9, the second horizontal wire 220 may have a height H1 measured at its ends 221 and 222, and a height 112 measured at its anterior point 223. In one example, a difference ΔH between the heights H1 and H2 may be between 0.5 and 6 inches. In another example, the difference ΔH may be between 1 and 4 inches. In a further example, the difference ΔH may be between 1.25 and 2.5 inches; and may be approximately 1.5 inches. As such, the horizontal wire 220 alone may protect a user's temples, cheek bones and upper jaw while being constructed with a single curvature.

Surprisingly, the inventors have found that the center vertical wire 250 does not obstruct or hinder a user's field of view. In particular, due to the horizontal anatomy of a user's eyes and the orientation of the center vertical wire 250 approximately along the sagittal plane "S", a user cannot easily focus on the center vertical wire 250, and the wire virtually disappears from a user's field of view. The visual presence of the center vertical wire 250 may be further diminished through a preferred wire construction. In particular, the vertical wire 250 may have a rectangular cross-sectional area, or the vertical center wire 250 may have a cross-sectional area, as viewed along an axis extending from the point 251 to the point 252, that is tapered in one or more directions. For example, the center vertical wire 250 may have a wedge-shaped cross-sectional area that tapers from a narrower width to a larger width in travelling toward or away from the user's eyes. In another example, the center vertical wire 250 may have an oval-shaped cross-sectional area that tapers from a narrower width at a side proximate to the user's eyes, to a larger width at a center of the wire, and back to a narrower width at a side distal from a user's eyes.

Methods of Manufacture

Suitable materials for constructing the cushioning layers 112 and 122, the straps 131-133, and the chin pad 140, may include materials such as: cotton, velveteen, linen, wool, canvas, nylon, spandex, polyester, leather, foam, ethylene-vinyl acetate (EVA), polyurethane, vinyl nitrile, and combinations of the foregoing. The inner cushioning layers 112 and 122, and the chin pad 140, will have contact surfaces for contacting a user's forehead and the back of a user's head respectively. In some examples, one or more of these contact surfaces may be made of a synthetic rubber material, such as neoprene or polychloroprene, or an equivalent thereof, to provide the contact surface with a friction-enhancing tacky surface texture that reduces shifting of the headband 110 or the harness 120 on the user's head. In this manner, each of the inner cushioning layer 112, the inner layer 122, and the chin pad 140 may be constructed with a user inwardly facing user contact surface that has a higher coefficient of friction than the coefficient of friction on an outwardly facing surface thereof. The forgoing textile components may be constructed by textile working methods such as stitching: sewing; weaving; knitting; braiding; thermal, mechanical, or chemical bonding; and combinations thereof.

Suitable structures for use as one or more of the fasteners 171-182 may include: one or more u-shaped clamps; one or more j-shaped hooks; mating arrangements of snap-fasteners; mating arrangements of hooks-and-loops (e.g., Velcro®); an opening adapted to receive a secured bolt therethrough; an opening adapted to receive a looped strap; a mating hook-and-clasp; a mating buckle-and-opening; and the like. If permanently affixing one or more components together then a fastener may be substituted by, or may include: stitching; gluing; welding; a monolithic construction (e.g., casting, molding, etc.); an integrated construction (e.g., closed or substantially-closed loops secured around a narrowed region in a received structure); and combinations of the foregoing.

The headband 110, the facemask 200, the plate 150, and the harness 120 (when constructed with a shell component), may be constructed and shaped from metal or plastic. Suitable metals may include: aluminum, steel, carbon, cobalt, chromium, iron, nickel, magnesium, tin, titanium, zinc, cast metals, and combinations thereof. Suitable plastics may include high impact plastics, such as polycarbonate, reinforced fiber plastics, carbon fiber, and combinations thereof. If constructed from metal, these components may be shaped by processes such as: stamping; pressing; spinning; casting; and combinations of the foregoing. Alternatively, if constructed from plastic, these components may be shaped by processes such as: blow molding; injection molding; extrusion; vacuum molding; hot-pressing; three-dimensional layering; and combinations of the foregoing.

When forming the facemask 200, one or more of the wires may be formed separately and affixed to one another to construct the wire cage 201. For example, each individual wire may be drawn into a straight rod, shaped with a desired curvature through one or more bending techniques, and welded to one another to construct the wire cage 201. Alternatively, a single metal rod may be bent to achieve the desired shape for one or more of the wires. For example, the first horizontal wire 210 and the third horizontal wire 230 may be constructed from a single perimeter wire that extends along the lengths identified as: the first horizontal wire 210, the lateral side 280, the third horizontal wire 230, and the lateral side 270. In a further aspect, all of the wires in the wire cage 201 may be constructed as a single monolithic structure (e.g., by a casting or molding process). If constructing the facemask 200 with a monolithic wire cage 201, then the headband 110 and plate 150 may also be constructed monolithically with the wire cage 201.

The wires of wire cage 201 may be constructed with a number of shapes. In one example, the wires are constructed as rounded rods. In another example, the wires have a rectangular shaped cross-section. In alternative examples, the wires may be flat bars, or bars having tapered cross-sections (e.g., wedge-shaped, oval shaped, etc.), and may be oriented to display a narrowed width in a user's field of view, thereby increasing the strength and integrity of the wire cage 201 while also minimizing both the interference to a user's field of view and the weight of the facemask 200. The wires of the wire cage 201 may be constructed with either solid cross-sections or hollow-cross sections. Wires constructed with a hollow cross-section may have a larger cross-sectional perimeter. For example, a wire constructed with a solid rectangular cross-section may have a perimeter measuring 0.127 inches by 0.235 inches, whereas the same wire constructed with a hollow rectangular cross-section may have a perimeter measuring 0.212 inches by 0.302 inches. In some examples, some of the wires may be constructed with a first shape and a first cross-section type (e.g., solid or hollow), while other wires in the wire grid 201 are constructed with a second shape and/or is second cross-sectional type. For example, the center wire 250 may be constructed with a first shape that improves both strength and visibility, while the remaining wires in the wire cage 201 are constructed with a second shape that improves strength though not visibility.

Though the foregoing examples focus primarily on a facemask having three horizontal wires and three vertical wires, other embodiments of the facemask may include additional vertical and/or horizontal wires. In particular, additional wires may be added to further narrow openings in the wire cage, as needed for a particular ball or other projectile; and/or to increase the strength and integrity of the wire cage. For example, additional vertical wires may extend between the second horizontal wire 220 and the third horizontal wire 230 through any of the openings 321-324. In another example, additional vertical wires may extend between the first horizontal wire 210 and either the second horizontal wire 220 or the third horizontal wire 230 respectively through the upper lateral openings 311 and 314 or through both the upper and lower lateral openings 311, 314, 321 and 324. In a further example, additional horizontal wires may extend between the lateral end 270 and the lateral vertical wire 240, and/or between the lateral end 280 and the lateral vertical wire 260. Such additional horizontal wires may extend along a user's temples, and be referred to as temple guards (or temple guard wires).

In embodiments where the wires are made from a metal material, a protective coating may be applied to the wires to prevent deterioration of the metal and/or any welding materials. Suitable protective coatings may include a bonded vinyl powder coating, dipped rubber coatings, and combinations and equivalents thereof.

Although the present invention has been described with reference to particular embodiments, it will be understood to those skilled in the art that the disclosure is exemplary only and that various other alternatives, adaptations, and modifications may be made within the scope and spirit of the present invention.

For example, although the foregoing examples have been discussed relative to softball and baseball headpieces, those skilled in the art will appreciate that the invention is also applicable to other athletic headpieces, as well as other headpieces not limited to athletic use. Also, although the foregoing examples focus primarily on embodiments wherein a headband is secured to user's head by a harness that is joined to the headband by one or more straps, it is understood that the headband may instead be secured to a user's head merely by one or more straps, without the inclusion of a harness. In addition, it is understood that the headband may be secured to a user's head by a harness that directly engages the headband without straps. For example, the harness may be constructed as either a fabric shell or a grid of fabric strands that is either affixed to the headband or carries one or more fasteners for engaging the headband without any straps interposed between the harness and the headband. Furthermore, although the foregoing examples discuss arrangements of the facemask in a harness-supported headpiece, those skilled in the art will appreciate that the facemask (as well as the facemask with a harness) may be used with helmets, including full-shell helmets. The invention may further include additional features, if desired, including features that are known and used in the art.

To the extent necessary to understand or complete the disclosure of the present invention, all publications, patents, and patent applications mentioned herein are expressly incorporated by reference to the same extent as though each were individually so incorporated. In addition, ranges expressed in the disclosure include the endpoints of each range, all values in between the end points, and all intermediate ranges subsumed by the end points and the values between the end points.

The present invention is not limited to the specific embodiments as illustrated herein, but is instead characterized by the appended claims.

What is claimed is:

1. An athletic headpiece, comprising:

a headband;

a harness operatively connected to the headband;

a facemask secured to the headband; and wherein the facemask comprises a wire cage comprising a plurality of horizontal wires and a plurality of vertical wires, wherein the plurality of horizontal wires consists of a first horizontal wire secured to the headband, a second horizontal wire that is configured to extend forward of a user's face at a height between the user's nose and the user's upper lip, and a third horizontal wire configured to form the bottom perimeter of the wire cage at a height between the user's bottom lip and below the user's chin, wherein the second horizontal wire comprises a first end point, a second end point, and an anterior point between the first and second end points, wherein the second horizontal wire comprises a single curvature between the first and second end points, and wherein the second horizontal wire is configured to protect a user's temples, cheek bones and upper jaw, wherein the plurality of vertical wires consists of a center vertical wire that is configured to extend along the sagittal line of a user's face from the first horizontal wire to the third horizontal wire, lateral ends at opposite sides of the wire cage that extend between the first horizontal wire and the third horizontal wire, a first pair of lateral vertical wires arranged on opposite sides of the center vertical wire that are configured to extend vertically from the first horizontal wire to the second horizontal wire, and a second pair of lateral vertical wires arranged on opposite sides of the center vertical wire that are configured to extend vertically from the second horizontal wire to the third horizontal wire, wherein the horizontal width between each first lateral vertical wire and the center vertical wire ranges from 1.4 inches to 2.8 inches and the horizontal width between each second lateral vertical wire and the center vertical wire ranges from 1.2 inches to 2.4 inches, wherein a space between the first horizontal wire and the second horizontal wire is a sight window that is configured to align with a user's eyes, and the center vertical wire divides the sight window into a right-eye opening configured to align with a user's right eye and a left-eye opening configured to align with a user's left eye.

2. The athletic headpiece of claim 1, wherein a length of the center vertical wire that extends between a point on the first horizontal wire and a point on the second horizontal wire is between 1.25 inches and 6 inches.

3. The athletic headpiece of claim 2, wherein the length of the center vertical wire that extends between the point on the first horizontal wire and the point on the second horizontal wire is between 1.5 inches and 5 inches.

4. The athletic headpiece of claim 1, wherein the second horizontal wire is affixed at the first and second end points to the lateral ends of the wire cage, and the second horizontal wire extends horizontally between the first horizontal wire and the third horizontal wire.

5. The athletic headpiece of claim 4, wherein the second horizontal wire is affixed at the first and second end points to the lateral ends of the wire cage at locations between locations where the lateral ends are affixed to the first horizontal wire and the third horizontal wire.

6. The athletic headpiece of claim 4, wherein a difference in height, as measured when the headpiece is worn by a user and the user levels their head relative to the transverse plane, between the first and second end points of the second horizontal wire and the anterior point of the second horizontal wire is between 0.5 inches and 6 inches.

7. The athletic headpiece of claim 6, wherein the difference in height between the end points of the second horizontal wire and the anterior point of the second horizontal wire is between 1.25 inches and 2.5 inches.

8. The athletic headpiece of claim 1, wherein:

the center vertical wire extends from the first horizontal wire to the third horizontal wire.

9. A facemask for an athletic headpiece comprising:

a wire cage comprising a plurality of horizontal wires and a plurality of vertical wires, wherein the plurality of horizontal wires consists of a first horizontal wire secured to a headband, a second horizontal wire that is configured to extend forward of a user's face at a height between the user's nose and the user's upper lip, and a third horizontal wire configured to form the bottom perimeter of the wire cage at a height below the user's bottom lip and below the user's chin, wherein the second horizontal wire comprises a first end point, a second end point, and an anterior point between the first and second end points, wherein the second horizontal wire comprises a single curvature between the first and second end points, and wherein the second horizontal wire is configured to protect a user's temples, cheek bones and upper jaw, wherein the plurality of vertical wires consists of a first pair of lateral vertical wires arranged on opposite sides of a center line of the wire cage that are configured to extend vertically from the first horizontal wire to the second horizontal wire, a second pair of lateral vertical wires arranged on opposite sides of a center vertical wire that are configured to extend vertically from the second horizontal wire to the third horizontal wire, the center vertical wire that is configured to extend along the sagittal line of a user's face from the first horizontal wire to the third horizontal wire, and a third pair of lateral vertical wires at opposite sides of the wire cage that extend between the first horizontal wire and the third horizontal wire, wherein the horizontal width between each lateral vertical wire in the first pair and the center line is 1.4 inches to 2.8 inches and the horizontal width between each lateral vertical wire in the second pair and the center line is 1.2 inches to 2.4 inches, wherein a space between the first horizontal wire and the second horizontal wire is a sight window that is configured to align with a user's eyes, and the center vertical wire divides the sight window into a right-eye opening configured to align with a user's right eye and a left-eye opening configured to align with a user's left eye.

10. The facemask of claim 9, wherein a length of the center vertical wire that extends between a point on the first horizontal wire and a point on the second horizontal wire is between 1.25 inches and 6 inches.

11. The facemask of claim 10, wherein the length of the center vertical wire that extends between the point on the first horizontal wire and the point on the second horizontal wire is between 1.5 inches and 5 inches.

12. The facemask of claim 9, wherein the second horizontal wire is affixed at the first and second end points to the lateral ends of the wire cage, and the second horizontal wire extends horizontally between the first horizontal wire and the third horizontal wire.

13. The facemask of claim 12, wherein the second horizontal wire is affixed at the first and second end points to the lateral ends of the wire cage at locations between locations where the lateral ends are affixed to the first horizontal wire and the third horizontal wire.

14. The facemask of claim 12, wherein a difference in height, as measured when the facemask is worn by a user and the user levels their head relative to the transverse plane, between the end points of the second horizontal wire and the anterior point of the second horizontal wire is between 0.5 inches and 6 inches.

15. The facemask of claim 14, wherein the difference in height between the end points of the second horizontal wire and the anterior point of the second horizontal wire is between 1.25 inches and 2.5 inches.

16. The facemask of claim 9, wherein the center vertical wire extends from the first horizontal wire to the third horizontal wire.

17. The athletic headpiece of claim 1, wherein the horizontal width between each first lateral vertical wire and the center vertical wire is 1.4 inches to 2.1 inches.

18. The facemask of claim 9, wherein the horizontal width between each first lateral vertical wire and the center line is 1.4 inches to 2.1 inches.

19. The athletic headpiece of claim 1, wherein the horizontal width between each second lateral vertical wire and the center vertical wire is 1.2 inches to 1.8 inches.

* * * * *